US006293060B1

(12) United States Patent
McKann et al.

(10) Patent No.: US 6,293,060 B1
(45) Date of Patent: Sep. 25, 2001

(54) DOOR FRAME WITH SECURING AND SEALING FLANGE

(75) Inventors: H. Smith McKann; Wendell Haney, both of Fredericksburg, VA (US)

(73) Assignee: Therma-Tru Technologies Incorporated, Maumee, OH (US)

( * ) Notice: Subject to any disclaimer, the term of this patent is extended or adjusted under 35 U.S.C. 154(b) by 0 days.

(21) Appl. No.: 09/317,995

(22) Filed: May 25, 1999

(51) Int. Cl.[7] ..... E06B 1/14

(52) U.S. Cl. ..... 52/211; 52/717.01; 52/716.8; 52/656.4; 52/745.16; 49/504

(58) Field of Search ..... 52/211, 212, 717.01, 52/716.8, 656.4, 745.16; 49/504

(56) References Cited

U.S. PATENT DOCUMENTS

| | | | | |
|---|---|---|---|---|
| 1,048,988 | | 12/1912 | Mayo . | |
| 1,085,605 | | 2/1914 | Gunn . | |
| 1,901,524 | * | 3/1933 | Baum | 52/212 |
| 2,581,750 | * | 1/1952 | Bursik | 52/211 X |
| 2,660,272 | | 11/1953 | Walterman et al. . | |
| 2,687,194 | | 8/1954 | Kelly . | |
| 2,741,344 | | 4/1956 | Herr . | |
| 2,755,895 | | 7/1956 | Walterman et al. . | |
| 2,818,947 | * | 1/1958 | Goldberg | 52/211 |
| 2,834,066 | | 5/1958 | Lybarger . | |
| 3,385,004 | * | 5/1968 | Oehler et al. | 52/211 X |
| 3,769,773 | * | 11/1973 | Mochizuki | 52/211 X |
| 3,906,671 | | 9/1975 | Maldonado . | |
| 4,453,346 | | 6/1984 | Powell et al. . | |
| 4,674,248 | * | 6/1987 | Hall | 52/212 |
| 4,793,109 | | 12/1988 | Noach . | |
| 4,813,204 | | 3/1989 | Rentschler . | |
| 5,187,898 | | 2/1993 | McKann . | |
| 5,412,922 | | 5/1995 | Vittori et al. . | |
| 5,613,324 | | 3/1997 | Theune . | |
| 5,619,823 | | 4/1997 | Ruff et al. . | |
| 5,634,303 | | 6/1997 | Ellingson . | |

FOREIGN PATENT DOCUMENTS

| | | | | |
|---|---|---|---|---|
| 630220 | * | 7/1963 | (BE) | 52/212 |

* cited by examiner

*Primary Examiner*—Laura A. Callo
(74) *Attorney, Agent, or Firm*—Roylance, Abrams, Berdo & Goodman, L.L.P.

(57) ABSTRACT

A door frame has hinge and latch jambs extending from opposite ends of a header jamb. Each jamb has an inside section for extending into a doorway opening in a wall and having a molding section extending laterally outwardly from the respective inside section for overlying a face of the wall adjacent the doorway opening. Each molding section includes an inner end extending from the inside section, an outer face extending generally perpendicularly from the inner end and an outer free end extending generally perpendicularly from the outer face. A jamb securing and sealing flange is joined to a jamb. The flange has first and second end sections coupled by a centered section. The first second is substantially parallel to and affix to a inner surface of the outer face of one jamb. The second end section extends substantially parallel to the first end section and laterally outwardly beyond its outer free end.

20 Claims, 4 Drawing Sheets

FIG.8
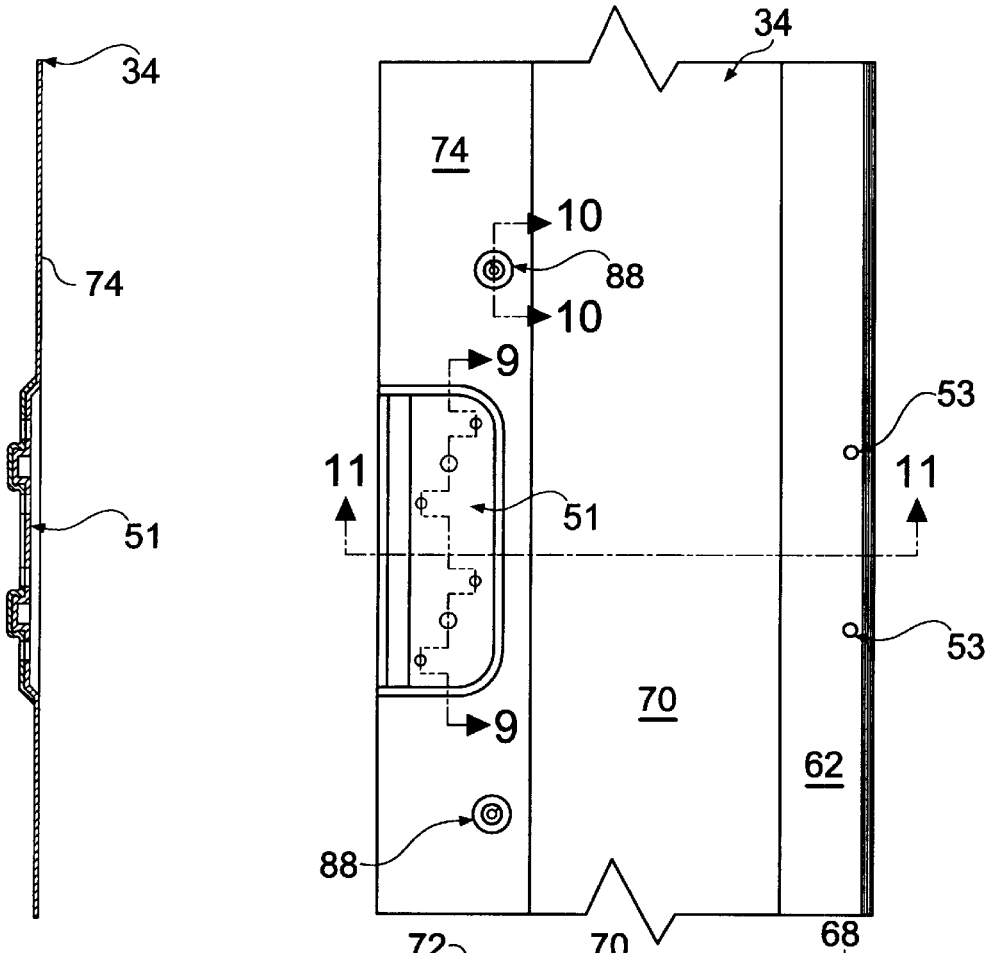
FIG.9
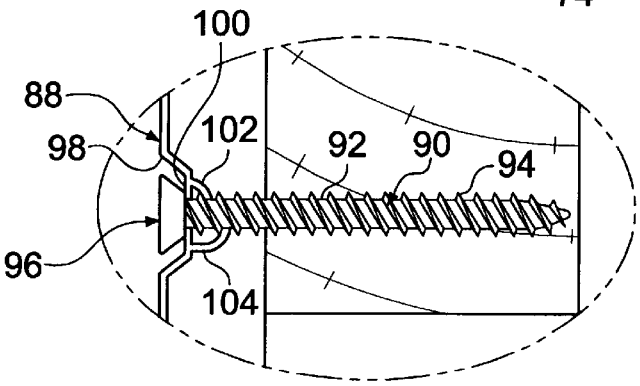
FIG.10
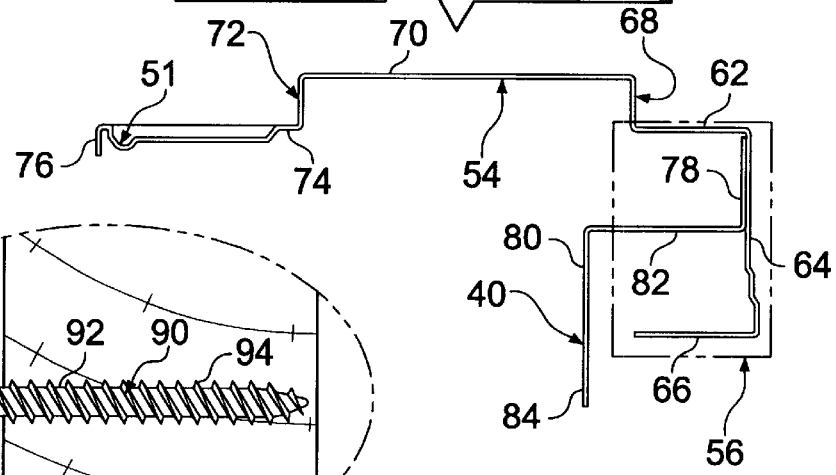
FIG.11

DOOR FRAME WITH SECURING AND SEALING FLANGE

FIELD OF THE INVENTION

The present invention relates to a door frame for mounting a door in a doorway opening in a wall. More particularly, the present invention relates to a door frame having a securing and sealing flange fixed to and extending laterally outwardly beyond the frame to provide a space between the frame molding section and the flange for receiving exterior siding.

BACKGROUND OF THE INVENTION

Conventional building industry practice involves prefabricated door frame assemblies which are manufactured at a manufacturing facility, and then transported to a remote location for installation in a building. This door frame assembly includes a door frame and one or more prehung doors. For multiply door assemblies, a storm door and a main or entrance door are provided. The door frame includes a header jamb for the top of the doorway opening and latch and hinge jambs for the sides of the doorway opening in the wall.

With the increase in cost of wood, metal frames, particularly those of steel, have become viable for residential use, as well as for commercial use. Thus, the use of metal door frames is expanding.

The frame should be adaptable to a wide variety of uses. Such uses include the presence or absence of a screen or storm door, in addition to the main door. Further, exterior trim should be provided.

In forming the door frame assembly, the amount of work performed at the factory should be maximized, while the amount of work to be done at the installation site must be minimized. In this way, installation in the field can be accomplished more simply with less experienced labor and more quickly saving time and expense. Further, installation must provide an overall attractive appearance when completed with the building siding and provide a sealed structure to avoid entry of contaminants into the building structure.

SUMMARY OF THE INVENTION

Accordingly, an object of the present invention is to provide a door frame which can be easily and economically manufactured and which can be used in a simple installation method.

Another object of the present invention is to provide a door frame which provides a sealed entry way.

A further object of the present invention is to provide a door frame which is adaptable to receive a screen or storm door and can be used with or without exterior trim.

Yet another object of the invention is to provide a door frame or door frame assembly which is rugged and sturdy.

The foregoing objects are basically obtained by a door frame comprising a header jamb, a hinge jamb, a latch jamb, and a jamb securing and sealing flange. The hinge and latch jambs depend from opposite ends of the header jamb. Each of the jambs has an inside section for extending into a doorway opening in a wall, and has a molding section extending laterally outwardly from the respective inside section for overlying a surface of the wall adjacent the doorway opening. Each molding section includes an inner end extending from the inside section, and outer face extending generally perpendicularly from the inner end, and an outer free end extending generally perpendicularly from the outer face. The flange has first and second end sections joined by a center section. The first end section is substantially parallel to and fixed to an inner surface of the outer face of the one the jambs. The second end section extends substantially parallel to the first end section and laterally outwardly beyond the respective outer free end.

The foregoing objects are also obtained by a method of mounting a door frame in a doorway opening in a wall having inside and outside faces, comprising the steps of locating a door frame adjacent to doorway opening, and then positioning the door frame in the doorway opening and positioning jamb securing and sealing flanges.

The door frame has a header jamb, a hinge jamb and a latch jamb, with the hinge and latch jambs extending from opposite ends the header jamb. In positioning the door frame in the doorway opening, the header jamb is located along a top of the doorway opening, while the hinge and latch jambs are located along opposite sides of the doorway opening. Inside sections of each hinge jamb are in the doorway opening, while molding sections of each end jamb extend laterally outwardly from the inside sections and overly an outside face of the wall adjacent the doorway opening. Each flange has first and second end sections joined by a center section with the first end sections being fixed to inner surfaces of the outer faces of the jambs. The second end sections extend laterally outwardly beyond outer free ends of the molding sections and abut the outside face of the wall adjacent the doorway opening. The flanges are then fixed to the outside face of the wall.

By forming the door frame and performing the method in this manner, the door frame can be easily manufactured and have a door mounted therein at the factory. Additionally, the door frame assembly can be easily installed within a doorway opening in an wall. The securing and sealing flange positively and correctly locates the frame within the doorway opening, provides a mechanism for securely attaching the frame to the wall and provides a seal, particularly against the intrusion of rain into the wall at the doorway opening.

Other objects, advantages, and salient features of the present invention will become apparent from the following detailed description, which, taken in conjunction with the annexed drawings, disclose a preferred embodiment of the present invention.

BRIEF DESCRIPTION OF THE DRAWINGS

Referring to the drawings which form a part of this disclosure:

FIG. 8 is a partial, side elevational view, viewed along lines 8—8 of FIG. 4;

FIG. 9 is a partial, front elevational view in section of the door frame taken along lines 9—9 of FIG. 8;

FIG. 10 is a partial, side elevational view in section of the door frame taken along lines 10—10 of FIG. 8;

FIG. 11 is a bottom plan view in section of the door frame taken along lines 11—11 of FIG. 8;

DETAILED DESCRIPTION OF THE INVENTION

Figure 1:
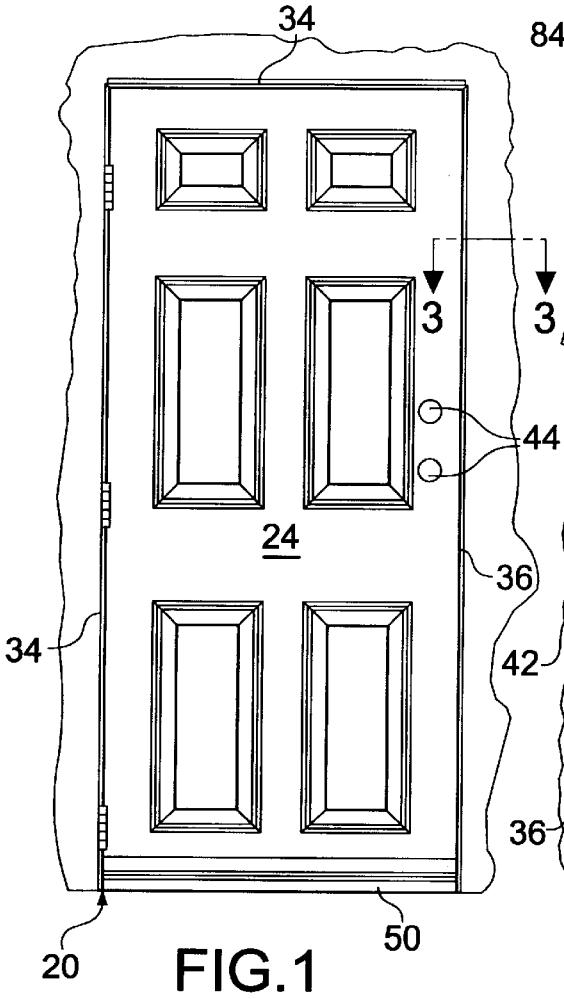
FIG. 1 is a rear elevational view of a door frame assembly mounted in a doorway opening in a wall, viewed from the interior of the structure, according to the present invention.
Figure 2:
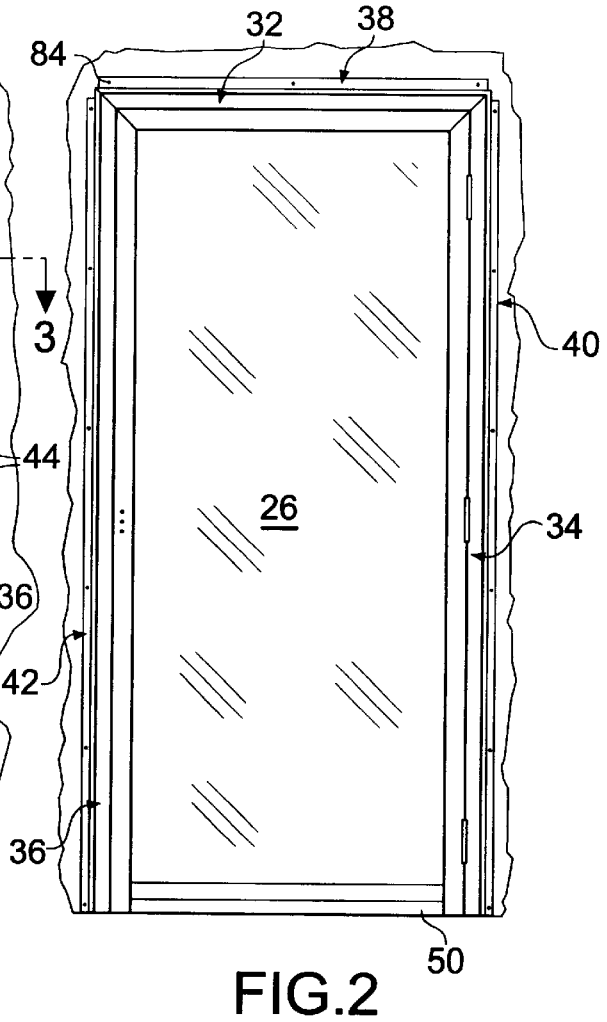
FIG. 2 is a front elevational view of the door frame assembly of FIG. 1, viewed from the exterior of this structure.

The door frame assembly 20, according to the embodiment of the present invention illustrated in the drawings, comprises a door frame which pivotally mounts an entrance door 24 and a storm door 26 in a doorway opening 28 in a building structure wall 30. The frame includes a header jamb 32, a hinge jamb 34 and a latch jamb 36. Anchoring or securing and sealing flanges 38, 40 and 42 are attached to and extend from jambs 32, 34 and 36, respectively.

Wall 30 can be of any convention form. For example, the wall can include wall studs 30*a*. Interior wall board 30*b* can form the inside face 60 of the wall. The outside face 58 is formed by exterior sheathing 30*c*.

Doors 24 and 26 are conventional, and thus, are not disclosed detail. A door knob and latch assembly is provided in entrance door 24 adjacent latch jamb 36. A suitable and similar knob and latch mechanism can be mounted on the adjacent edge of storm door 26.

Figure 12:
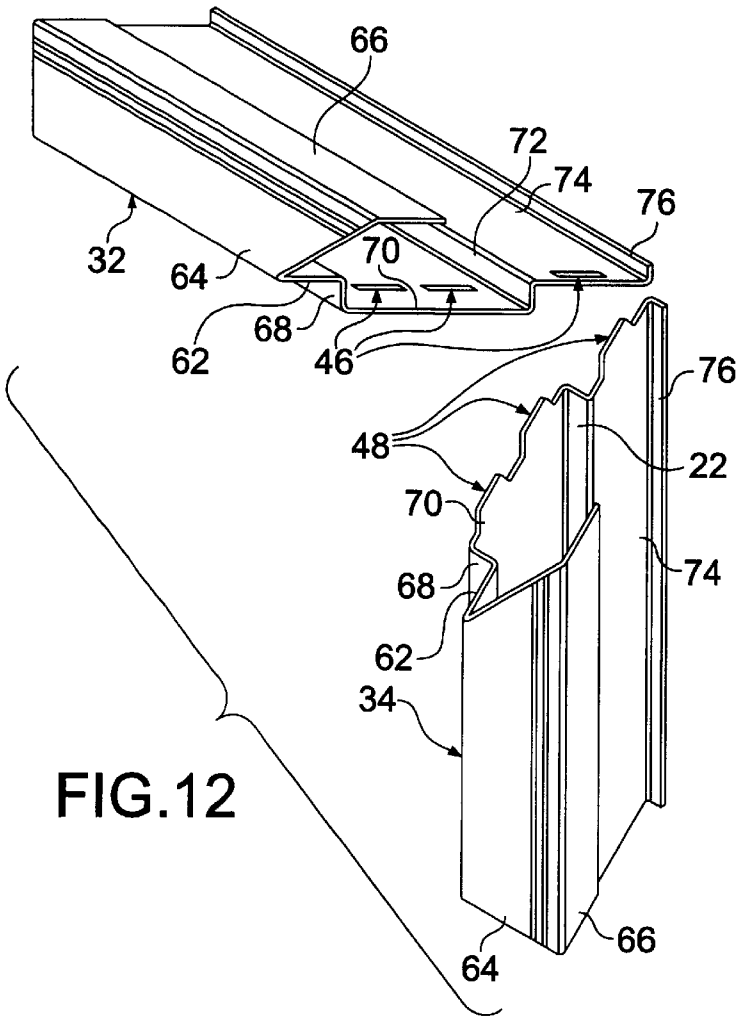
FIG. 12 is an exploded, partial perspective view of the door frame of FIG. 1, without the securing and sealing flanges.

Door frame 22, without the securing and sealing flanges, is generally conventional. As illustrated in FIG. 12, header jamb 32 comprises a series of slots 46 adjacent each longitudinal thereof. The upper ends of each of the latch and hinge jambs have tabs 48 shaped, dimensioned and spaced to fit within slots 46. After the tabs are located in the slots, the tabs are bent to positively secure the latch and hinge jambs to the header jamb, with the latch and hinge jambs depending from the opposite ends of the header jamb. For the purposes of illustration in FIG. 12, the securing and sealing flanges are omitted.

Figure 13:
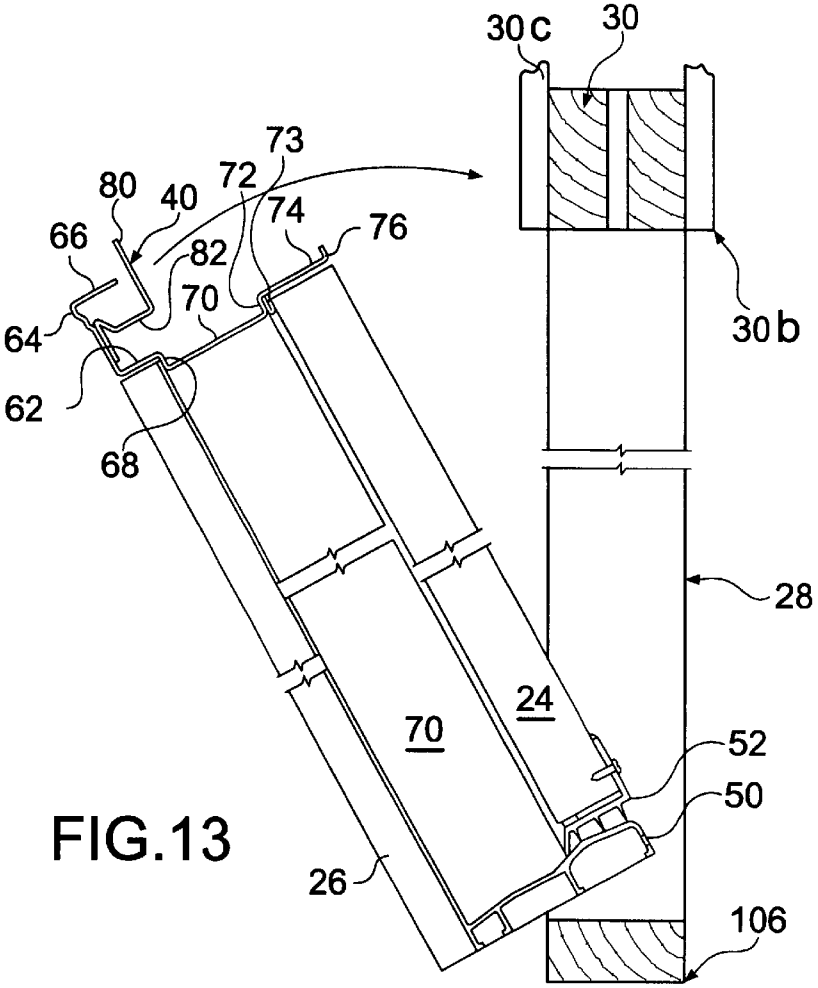
FIG. 13 is a side elevational view in section illustrating the installation of the door frame into a doorway opening in a wall according to the present invention.

Door frame assembly 22 can also be provided with a threshold 50 (FIG. 13). Threshold 50 is conventional and is coupled to and extends between the lower ends of the hinge and latch jambs, located remote from header jamb 34. Threshold 50 is arranged to mate with a door threshold seal 52, attached along the lower edge of entrance door 24.

Hinge jamb 34 has hinge plate receiving areas 51. Areas 51 are recessed and reinforced with back plates (FIGS. 9–11). Hinge screw holes 53 are provided in the hinge jamb for mounting the storm door hinges.

Each jamb generally comprises an inside section 54 which extends into doorway opening 28, and a molding section 56 extending laterally outwardly from the respective inside section. The molding section overlies an exterior or outside surface or face 58 of wall 30.

Each molding section is generally in the form of a brickmold profile, and includes an inner end 62 which extends from inside section 54, and outer face 64 extending generally perpendicularly from the inner end and an outer free end 66 extending generally perpendicularly from outer face 64.

Each inside section 54 includes a storm door stop or abutment 68, a soffit 70, an entrance or main door stop or abutment 72 and a mounting portion 74. Storm door stop 64 extends generally perpendicularly from inner end 62 from an end thereof remote from outer face 64 and in the same direction as outer free end 66. Soffit 70 extends perpendicularly from stop 68 from an end thereof remote from inner end 62 and in a direction opposite inner end 62. Entrance stop 72 extends perpendicularly from soffit 70 from its end remote from stop 68 and can support a door seal 73. Stops 68 and 72 extend in the same direction from soffit 70, but face in opposite directions. Mounting portion 74 extends perpendicularly from the end of stop 72 remote from soffit 70 and in a direction opposite to soffit 70. Mounting portion 74 terminates in a perpendicularly extending end part 76 located on the end of mounting portion 74 remote from stop 72 and extending in a direction opposite to stop 72.

For each jamb, outer free end 66, outer face 64, inner end 62, stop 68, soffit 70, stop 72, mounting portion 74, and end part 76 are unitarily formed for a single piece of sheet metal. The sheet metal is formed in a suitable and conventional process, by cutting and bending, to form the jambs.

Each of the securing and sealing flanges 38, 40 and 42 comprises a first end section 78, a second end section 80 and a center section 82 joining the first and second end sections. The first end section is substantially planar and is parallel to and fixed to an inner surface of outer face 64 of the respective jamb. Center section 82 extends substantially perpendicularly from one end of the first end section so as to be parallel to and spaced from inner end 62 by first end section 78. The second end section extends from the end of the center section 82 remote from first end section 78 and in a direction parallel to and opposite to first end section 78. Second end section 80 extends outwardly beyond the outer periphery of the jamb defined by outer free end 66. Outer free end 66 and second end section 82 are spaced in a direction perpendicular to second end section 80 and in the plane of outer free end 66.

First and end section 78 of each flange can be fixed to the respective jamb in any suitable manner. Preferably, the fixing is accomplished by welding.

Holes 84 are formed in second end section 80 of each of the flanges along longitudinally spaced locations. These holes receive fasteners 86, preferably in the form of nails, which extend through the holes and into wall 30. Since the flanges, including the holes, are located radially outside of jamb outer free ends 66, and thus, outside of lateral periphery of the jambs, the holes are readily accessible and the fasteners can be easily inserted and nailed into the wall without interference from the remaining jamb parts. This relative orientation greatly facilitates the installation of the frame assembly.

The inside section of at least the hinge jamb and the latch jamb have fastener holes 88 formed therein for receiving and externally threaded screw 90 (FIGS. 8 and 10). Screw 90 has a screw root 92 and a screw crest 94. One end of the screw is provided with a head 96. Each fastener hole has a countersunk portion 98 configured to receive head 96. The countersunk portion terminates at a base 100 forming the an aperture for the screw with a diameter corresponding generally to the screw root diameter, and thus, less than the screw crest diameter.

A short arcuate portion 102 and a long arcuate portion 104 extend diametrically opposite one another from the inner surface of the jamb mounting portion 74 to engage different portions of screw root 92 in a manner simulating a screw thread in the frame. Specifically, each arcuate portion extends from base 100 from a location outside the crest diameter and terminates at a free end that engages screw root 92. The portions of the screw root engaged by arcuate portions 102 and 104 are axially spaced from one another along the screw axis. This arrangement for gripping the anchor screw and the jamb provides a positive connection between the jamb and the screw. This positive connection properly positions the jamb without the use of shims.

Figure 3:
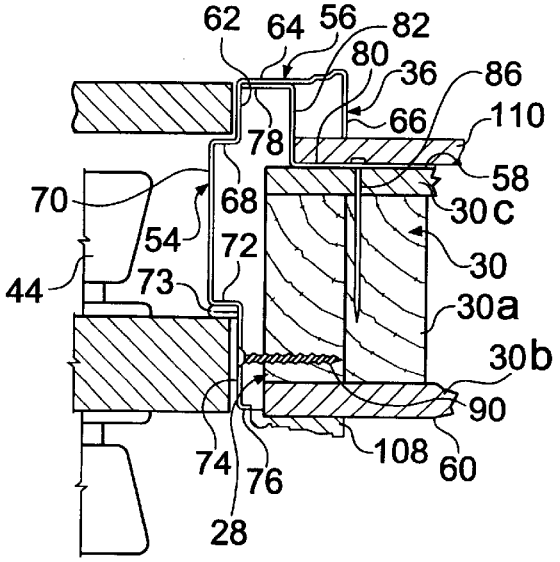
FIG. 3 is a partial, top plan view in section of the door frame assembly taken along line 3—3 of the FIG. 1.
Figure 4:
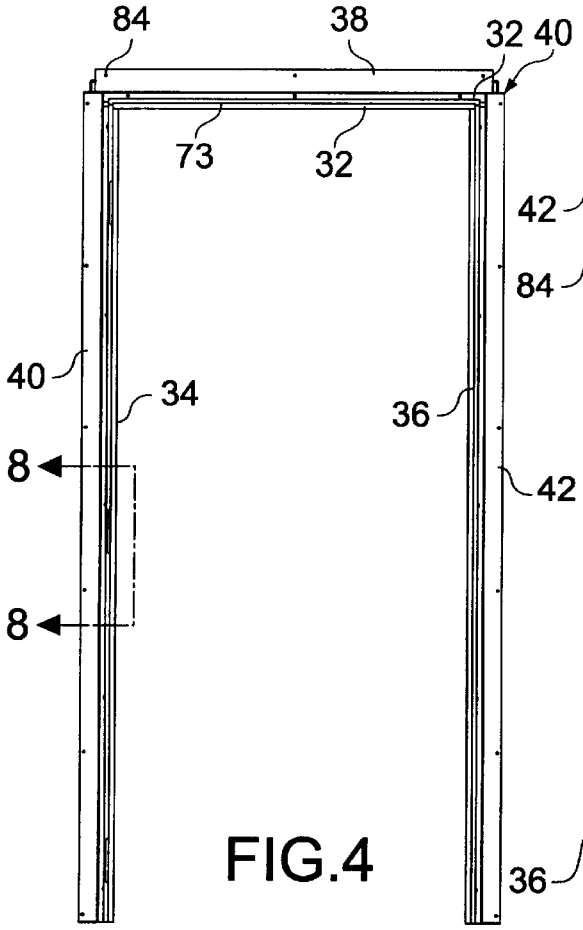
FIG. 4 is a rear elevational view of the door frame of FIG. 1.
Figure 5:
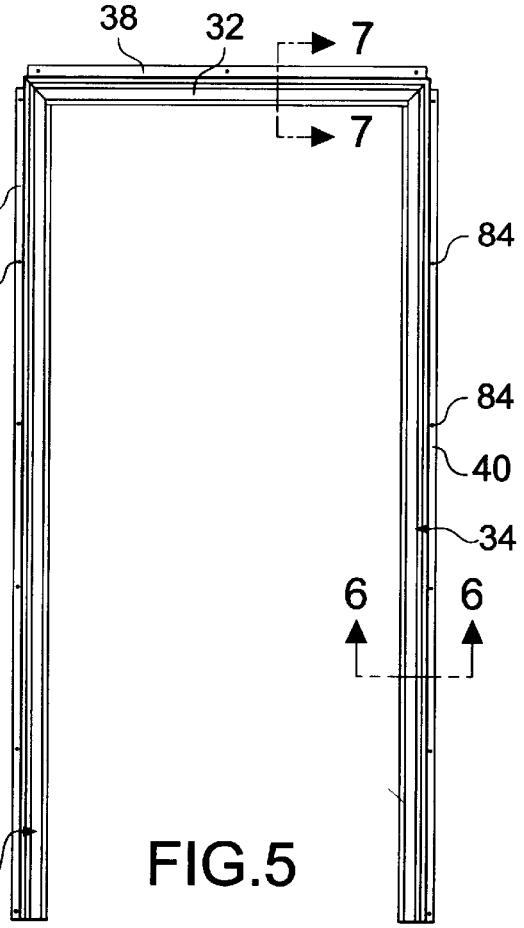
FIG. 5 is a front elevational view of the door frame of FIG. 1.
Figure 6:
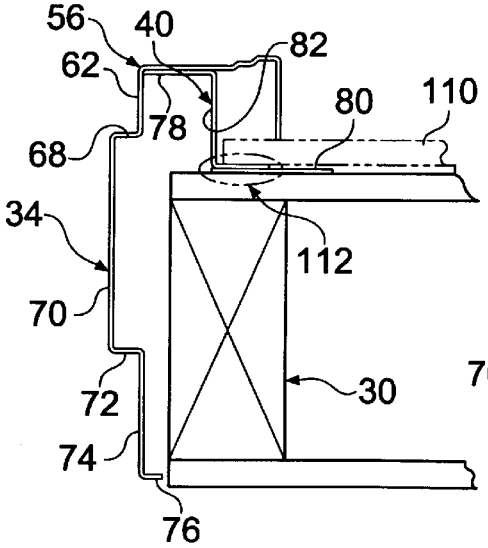
FIG. 6 is a bottom plan view in section of a door frame taken long line 6—6 of FIG. 5, with the addition of the adjacent wall portion.
Figure 7:
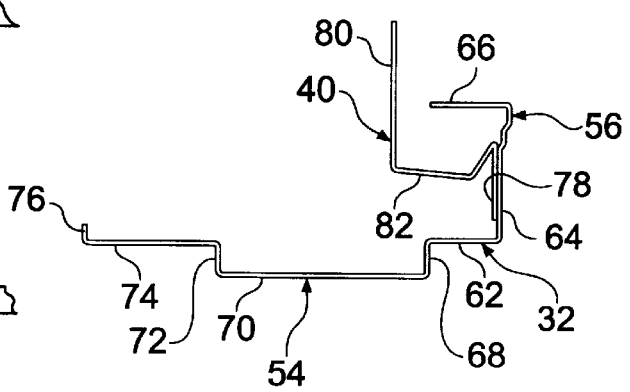
FIG. 7 is a side elevational view in section of the door frame taken long lines 7—7 of FIG. 5.

In installing the frame assembly in the door way opening, the door frame assembly is located adjacent the doorway opening in the wall. The frame is then lifted into place, as illustrated in FIG. 13, with threshold 50 resting on wall base 106. The frame is then pivoted and slid into place with second end sections 80 of each of the three flanges abutting exterior sheathing 32*c* of the wall. Once the frame is in its desired position, fasteners 86 are passed through holes 84 in the flanges and into the wall, and screws 90 are passed through fastener holes in 88 the jambs to secure the jambs in the proper position, as particularly illustrated in FIG. 3. In the position illustrated in FIG. 3, the free ends of end parts 76 are spaced from the wall by a predetermined distance. The space can be covered by suitable interior molding 108.

On the exterior side of the wall, siding 110 is added. The siding is located within the spaces or gaps between the jamb outer free ends 66 and second end sections 80 of the three flanges. Between the siding and second end sections, suitable sealing material 112 is provided to provide a continuous seal around the entire perimeter of the door assembly.

While a particular embodiment has been chosen to illustrate the invention, it will be understood by those skilled in the art, that various changes and modifications can be made therein without departing from the scope of the invention as defined in the appended claims.

What is claimed is:

1. A door frame, comprising:

a hinge jamb and a latch jamb depending from opposite ends of a header jamb, each of said jambs having an inside section for extending into a doorway opening in a wall and having a molding section extending laterally outwardly from the respective inside section for overlying a face of the wall adjacent the doorway opening;

each said molding section including an inner end extending from said inside section, an outer face extending generally perpendicularly from said inner end and an outer free end extending generally perpendicularly from said outer face; and a first jamb securing and sealing flange having first and second end sections joined by and extending in opposite directions from a center section, said first end section being substantially parallel to and fixed to an inner surface of said outer face of one of said jambs, said second end section extending laterally outwardly beyond and spaced from a free edge of the respective outer free end by a predetermined distance to receive siding therebetween.

2. A door frame according to claim 1 wherein said first and second end sections extend in parallel planes from said center section.

3. A door frame according to claim 1 wherein said first end section is welded to said outer face of said one jamb.

4. A door frame according to claim 1 wherein a second jamb securing and sealing flange comprises first and second end sections joined by and extending in opposite directions from a center section, said first section of said second flange being substantially parallel to and fixed to an inner surface of said outer face of a second one of said jambs, said second end section of said second flange extending substantially parallel to said first end section thereof and laterally outwardly beyond and spaced from a free edge of said outer free end of said second one of said jambs by a predetermined distance.

5. A door frame according to claim 4 wherein a third jamb securing a sealing flange comprises first and second end sections joined by and extending in opposite directions from a center section, said first section of said third flange being substantially parallel to and fixed to an inner surface of said outer face of a third one of said jambs, said second end section of said third flange extending substantially parallel to said first end section thereof and laterally outwardly beyond and spaced from a free edge of said outer free end of said third one of said jambs by a predetermined distance.

6. A door frame according to claim 1 wherein said inside section of each of said jambs comprises a main door abutment and a storm door abutment joined by a soffit inside portion, said door abutments facing in opposite directions.

7. A door frame according to claim 6 wherein said inside section and said molding section of each said jamb are unitarily formed from a single piece of material.

8. A door frame according to claim 1 wherein said inside section and said molding section of each said jamb are unitarily formed from a single piece of material.

9. a door frame according to claim 1 wherein said inside section of said hinge jamb and said latch jamb have at least one fastener hole therein receiving an externally threaded screw with a thread root and a thread crest.

10. A door frame according to claim 9 wherein each said fastener hole comprises two lateral, substantially coplanar, flanges which extend said thread root of the respective screw, and first and second arcuate portions extending different distances from an inner surface of the respective jamb to engage two axially spaced parts of said thread root of the respective screw.

11. A door system, comprising:

a wall with a doorway opening therein and with inside and outside faces;

a door frame mounted on said wall and extending into said doorway opening, said door frame including a hinge jamb and a latch jamb depending from opposite ends of a header jamb, each of said jambs having an inside section extending into said doorway opening and having a molding section extending laterally outwardly from the respective inside section and overlying said outside face of said wall adjacent said doorway opening, each said molding section having an inner end extending from said inside section, an outer face extending generally perpendicularly from said inner end and an outer free end extending generally perpendicularly from said outer face, and first, second and third jamb securing and sealing flanges each having first and second end sections joined by and extending in opposite directions from a center section, each said first end section being substantially parallel to and fixed to an inner surface of said outer face of the respective jamb, said second end section extending laterally outwardly beyond and spaced from a free edge of the respective outer free end and overlying said outside face adjacent said doorway opening; and exterior siding material mounted over said second end sections and extending between said free edges and said second end sections.

12. A door system according to claim 11 wherein fasteners extend through said second end sections and into said wall.

13. A door system according to claim 11 wherein said first and second end sections of each said flange extend in parallel planes.

14. A door system according to claim 11 wherein sealing material extends between said exterior siding material and said second end sections of said flanges.

15. A method of mounting a door frame in a doorway opening in a wall having inside and outside faces, comprising of steps of:

locating a door frame adjacent a doorway opening in a wall with the door frame having a hinge jamb and a latch jamb extending from opposite ends of a header jamb;

positioning the door frame in the doorway opening with the header jamb along a top of the doorway opening and the hinge and latch jambs along opposite sides of the doorway opening, with inside sections of each jamb being located in the doorway opening and with a molding section of each jamb extending laterally outwardly from the respective inside section and overlying an outside face of the wall adjacent the doorway opening;

positioning jamb securing and sealing flanges, each having first and second end sections joined by and extending in opposite directions from a center section with the first and sections fixed to inner surfaces of outer faces of the jambs, such that the second end sections extend laterally outwardly beyond and are spaced from free edges of outer free ends of the molding sections by a predetermined distance and abut the outside face of the wall adjacent the doorway opening; and fixing said flanges to the outside face of the wall.

16. A method according to claim 15 wherein exterior siding material is mounted over the flange second end sections and between the free edges and the second end sections.

17. A method according to claim 15 wherein fasteners are passed through holes in the flanges and into the wall.

18. A door frame, comprising:

a hinge jamb and a latch jamb depending from opposite ends of a header jamb, each of said jambs having an inside section for extending into a doorway opening in a wall and having a molding section extending laterally outwardly from the respective inside section for overlying a face of the wall adjacent the doorway opening;

each said molding section including an inner end extending from said inside section, an outer face extending generally perpendicularly from said inner end and an outer free end extending generally perpendicularly from said outer face;

a first jamb securing and sealing flange having first and second end sections joined by a center section, said first end section being substantially parallel to and fixed to an inner surface of said outer face of one of said jambs, said second end section extending and laterally outwardly beyond the respective outer free end; and at least one fastener hole in said inside section of said hinge jamb and said latch jamb receiving an externally threaded screw with a thread root and a thread crest, each said fastener hole including two lateral, substantially coplanar, flanges which engage said thread root of the respective screw, and first and second arcuate portions extending different distances from an inner surface of the respective jamb to engage two axially spaced parts of said thread root of the respective screw.

19. A door system, comprising:

a wall with a doorway opening therein and with inside and outside faces;

a door frame mounted on said wall and extending into said doorway opening, said door frame including a hinge jamb and a latch jamb depending from opposite ends of a header jamb, each of said jambs having an inside section extending into said doorway opening and having a molding section extending laterally outwardly from the respective inside section and overlying said outside face of said wall adjacent said doorway opening, each said molding section having an inner end extending from said inside section, an outer face extending generally perpendicularly from said inner end and an outer free end extending generally perpendicularly from said outer face, and first, second and third jamb securing and sealing flanges each having first and second end sections joined by a center section and extending in parallel planes and in opposite directions for the respective center section, each said first end section being substantially parallel to and fixed to an inner surface of said outer face of the respective jamb, said second end section extending laterally outwardly beyond the respective outer free end and overlying said outside face adjacent said doorway opening; and exterior siding material mounted over said second end sections and extending between said molding sections and said second end sections.

20. A door system, comprising:

a wall with a doorway opening therein and with inside and outside faces;

a door frame mounted on said wall and extending into said doorway opening, said door frame including a hinge jamb and a latch jamb depending from opposite ends of a header jamb, each of said jambs having an inside section extending into said doorway opening and having a molding section extending laterally outwardly from the respective inside section and overlying said outside face of said wall adjacent said doorway opening, each said molding section having an inner end extending from said inside section, an outer face extending generally perpendicularly from said inner end and an outer free end extending generally perpendicularly from said outer face, and first, second and third jamb securing and sealing flanges each having first and second end sections joined by a center section, each said first end section being substantially parallel to and fixed to an inner surface of said outer face of the respective jamb, said second end section extending laterally outwardly beyond the respective outer free end and overlying said outside face adjacent said doorway opening;

exterior siding material mounted over said second end sections and extending between said molding sections and said second end sections; and sealing material extending between said exterior siding material and said second end sections of said flanges.

* * * * *